US005657494A

United States Patent [19]

Diethelm

[11] Patent Number: 5,657,494

[45] Date of Patent: Aug. 19, 1997

[54] TOILET FLUSHING DEVICE

[75] Inventor: Alois Diethelm, Vorderthal, Switzerland

[73] Assignee: Geberit Technik AG, Jona, Switzerland

[21] Appl. No.: 576,286

[22] Filed: Dec. 21, 1995

[30] Foreign Application Priority Data

Jan. 16, 1995 [CH] Switzerland ..... 119/95

[51] Int. Cl.[6] ..... E03D 1/14; F16K 21/16; F16K 31/22

[52] U.S. Cl. ..... 4/324; 4/325; 4/415; 137/398; 137/403; 137/410; 137/433

[58] Field of Search ..... 137/395, 397, 137/398, 403, 404, 410, 430, 433, 436, 441, 442, 443, 444, 400, 401; 4/324, 325, 366, 398, 389, 390, 391, 395, 415

[56] References Cited

U.S. PATENT DOCUMENTS

| | | | |
|---|---|---|---|
| 2,077,832 | 4/1937 | Gebert | 4/391 |
| 3,419,912 | 1/1969 | Kertell | 4/391 |
| 4,011,605 | 3/1977 | Karlsson et al. | 4/391 |
| 4,304,014 | 12/1981 | Thompson | 4/325 |
| 4,566,140 | 1/1986 | Musgrove | 4/324 |
| 4,748,699 | 6/1988 | Stevens | 4/325 |
| 4,882,793 | 11/1989 | Thompson | 4/324 |
| 5,023,960 | 6/1991 | Ratanagsu | 4/391 |
| 5,265,282 | 11/1993 | Schmucki | 4/325 |
| 5,305,474 | 4/1994 | Nardi et al. | 4/324 |
| 5,331,690 | 7/1994 | Pourcier | 4/324 |

FOREIGN PATENT DOCUMENTS

| | | | |
|---|---|---|---|
| 609998 | 12/1989 | Australia | 4/391 |
| 0448092A1 | 3/1991 | European Pat. Off. . | |
| 4113497 | 10/1992 | Germany | 4/391 |
| 36 18 671 C2 | 5/1993 | Germany . | |
| 92 15 972 | 5/1994 | Germany . | |
| 587295 | 1/1959 | Italy | 4/391 |
| 2077790 | 12/1981 | United Kingdom | 4/391 |

*Primary Examiner*—George L. Walton
*Attorney, Agent, or Firm*—McGlew & Tuttle

[57] ABSTRACT

The flushing device has an actuating device for optionally triggering a complete or partial flushing. A valve body of drain fittings is raised for this purpose. In the case of a partial flushing, the valve body is raised with a weight body, which loads the valve body with the valve body raised and brings same prematurely into the closed position against the lifting force of a float after a flushing process has been triggered. A coupling device has a switching member mounted on the weight body in its lower area. This switching member automatically connects the weight body to the valve body during the raising of the weight body with a pulling element connected to the weight body.

17 Claims, 2 Drawing Sheets

24
27
26
14
25
37
15
25a
38
25b
32
13
16
34
17
S
18
20a
12c
12a
12
31
20
12b
19
36
21
22
23
7
1
4
8
6
9
10
2
3
5
33
28
29
30
4
13
7
124
A
114
115
107
140
141
116
113
120a
111a
111
119
136
121
123
104
101
108
102

TOILET FLUSHING DEVICE

FIELD OF THE INVENTION

The present invention pertains to a flushing device in a toilet flush tank, with an actuating device, with which a valve body of drain fittings is to be raised for optionally triggering a complete or partial flushing, wherein the valve body is to be raised with a weight body in the case of a partial flushing, and when the valve body is raised, the weight body loads the valve body in order to bring it prematurely into the closed position against the lifting force of a float after triggering the flushing process, and with a coupling means between the valve body and the weight body. In addition, the present invention pertains to drain fittings for a flush tank, with a housing and with a weight body, which is supported on the said housing and can be coupled with the valve body by means of a connection member for loading the valve body.

BACKGROUND OF THE INVENTION

Flushing devices and drain fittings of this type have been known, and they make it possible to save considerable amounts of flushing water. Therefore, there is great public interest in the widespread use of such flushing devices. The flushing devices which have become known to date and have been used in practice usually have a very complicated design and consist of many individual parts.

For example, a flushing devices, in which the valve body is connected to a weight body in the resting position, is disclosed in EP-A-0 448 092. The weight body is separated from the valve body in the case of complete flushing. In contrast, the weight body is raised with the valve body in the case of partial flushing.

German Utility Patent No. DE-U-92 15 972 discloses drain fittings, which also make possible a complete or partial flushing. This operates with an auxiliary valve and an additional auxiliary valve as well as with an overflow chamber, and it likewise has a very complicated design.

Finally, DE-A-36 18 671 discloses a flushing means in a toilet flush tank, in which a weight supported on the float housing is carried during the raising of the valve body by means of a control member for triggering a partial flushing.

SUMMARY AND OBJECTS OF THE INVENTION

The primary object of the present invention is to provide a flushing means as well as drain fittings, which make possible a simpler and less expensive design.

The object is accomplished in a flushing means of this type by the coupling means having—in a lower area of the weight body—a switching member, which is mounted on the weight body and which automatically connects the weight body to the valve body during the raising of the weight body with a pulling element connected to it. The drain fittings according to the present invention are characterized in that the weight body is connected to the said housing such that during the raising of the weight body, the housing moves the connection member to load the raised valve body with the weight body.

Thus, the housing of the drain fittings according to the present invention is used to move the connection member. The housing of the fittings thus assumes an additional task. The connection member can thus be arranged in a flush tank so deeply that it is located in the flushing water with the flushing tank filled and it is less susceptible to the formation of lime deposits as a result. The reliability of operation can thus be improved. The connection member can be extensively integrated in the housing of the drain fittings, so that a very compact design can be achieved. This is extremely advantageous especially in the case of a so-called concealed flush tank, because very little space is available in such a flush tank, especially in the upper area.

An especially simple and reliably operating design is obtained if the switching member or the connection member in the flushing means according to the present invention has a handle. This can then be moved especially by the housing of the drain fittings to latch the weight body onto the valve body during the raising of the weight body. To trigger a partial flushing, the valve body can then be raised directly by the weight body. According to a variant of the present invention, the weight body is provided for this purpose with an upwardly projecting arm, which is engaged by a pulling element. This pulling element may be a pivot lever, which has a pushbutton that can be operated from the outside. On depressing the pushbutton, the pulling element will directly grasp the weight body in order to raise it. The valve tube is carried together with the weight body. When the pushbutton is released, the weight body loads the valve body and forces same prematurely onto the seat of the drain valve before the flush tank is completely emptied.

According to a variant of the present invention, a stop, which is in functional connection with the valve body in order to raise it, is arranged on the weight body.

According to a variant of the present invention, the lid of the drain fittings is rotatably mounted on the housing of the drain fittings. This offers the advantage that the drain fittings can be mounted in any rotated position. The automatic mounting of the flushing means or of the drain fittings is substantially simplified hereby.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2, 3:
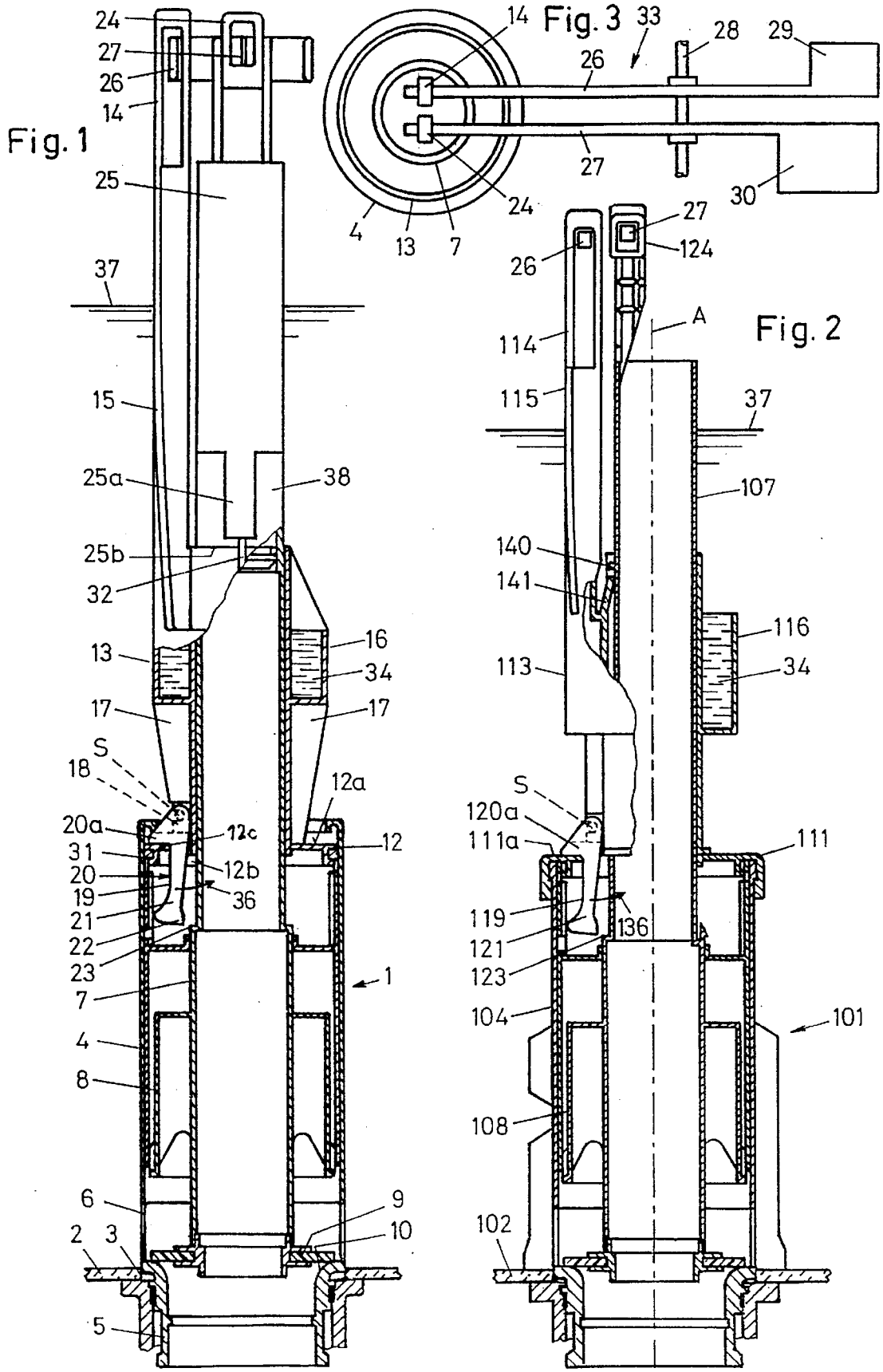
FIG. 1 is a front view of a flushing device according to the present invention with drain fittings according to the present invention, as well as a partial sectional view of a flush tank.
FIG. 2 is a sectional view of a variant of the flushing means according to the present invention.
FIG. 3 is a schematic top view of an actuating device.
Figure 4:
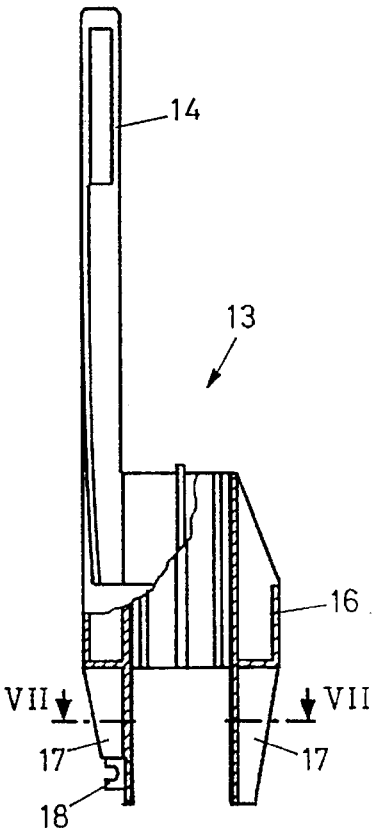
FIG. 4 is a partial cutaway view of a weight body.

As is shown in FIG. 1, a float housing 4 of drain fittings 1 is fastened to a discharge pipe 5 in an opening 3 of a flush tank 2. To actuate the drain fittings 1, an actuating device 33, which is shown schematically in FIG. 3, is arranged in the upper part of the flush tank 2, not shown here. This actuating device 33 has two pulling elements 26 and 27, which are mounted on a web 28 of the flush tank or of the flush tank lid preferably in a mutually independently pivotable manner. These elements 26 and 27 have—at one end—a respective pushbutton 29 and 30, which are accessible from the outside and are usually to be actuated manually to trigger a flushing. At the end located opposite the pushbutton 29, the pulling element 26 is inserted into a lug 14 of weight body 13. When the pushbutton 29 is depressed, the weight body 13 is raised. With the end located opposite the pushbutton 30, the other pulling element 27 engages a lug 24 of a valve body 7, which is designed here as an overflow pipe. When the pushbutton 30 is depressed, the valve body 7 is raised. To raise the weight body 13 and the valve body 7, the pulling elements 26 and 27 may also be actuated by means of, e.g., a pushbutton, which is commonly used in ceramic flush tanks. Other actuating devices, with which the weight body 13 or the valve body 7 can be optionally raised, are also conceivable.

When the valve body 7 is raised with the pulling element 27, a disk 9 arranged on the lower body of the valve body 7 is raised off a valve seat 10 of the drain fittings 1. Water present in the flush tank 2 can flow through window 6 of the housing 4 through the connection piece 5 into a toilet bowl, not shown here. The raised valve body 7 is held by the float 8 floating in the known manner until the flush tank is essentially completely emptied. A so-called complete flushing is thus triggered by depressing the pushbutton 30. The weight body 13 does not participate in this. The valve body 7 is composed of a lower part 38 and an upper, tubular part 25, snapped onto the former. Part 25 forms an extension of the valve body 7 and can be replaced with a part of a different length for adjustment to the height of the flush tank. Part 25 is detachably snapped onto the lower part 38 with two snap-in pins 25*a* made in one piece with it.

Figure 5:
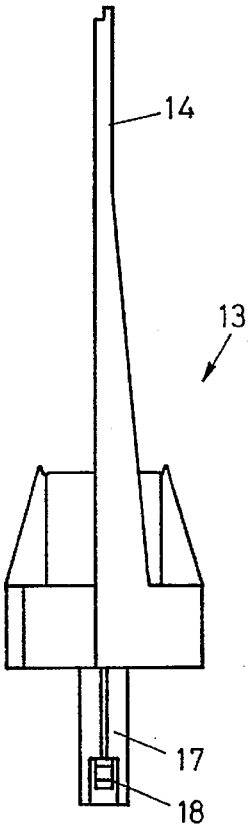
FIG. 5 is a front view of the weight body.
Figure 6:
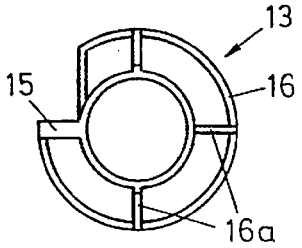
FIG. 6 is a top view of the weight body.
Figure 7:
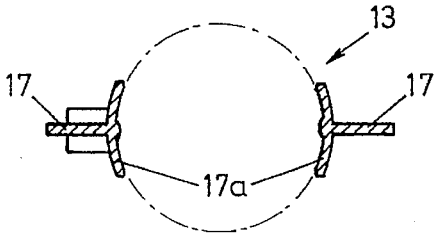
FIG. 7 is a sectional view through the weight body along line VII—VII in FIG. 4.

To trigger a partial flushing, the pushbutton 29 is actuated, and the weight body 13 is thus raised. This body 13 is supported at its lower end on a lid 12 of the housing 4 with stilts 17 made in one piece with it, and it is displaceably guided on the valve body 7. A container 16, which is open at the top, is filled with water 34, which forms an additional weight with the flush tank partially emptied. The stilts 17, which are located opposite each other at spaced locations from one another and extend in the downward direction, are made in one piece with and underneath the tank 16. As is shown in FIGS. 5 and 7, a transversely extending wall 17*a* each, which reinforces the stilts 17 and stabilizes the weight body 13 at the valve tube 7, is made in one piece with the stilts 17. A lid 12, which is offset in the downward direction and is rotatably fastened to the housing 4 with a snap-in connection 31, carries the weight body 13, which is placed on a top side 12*a* of this part 12.

Figure 8:
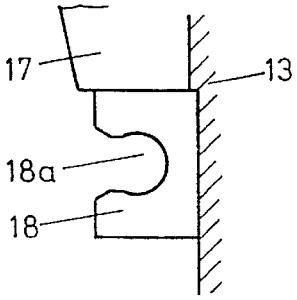
FIG. 8 is a greatly enlarged detailed view of the weight body.

The lid 12 is provided with an opening 12*b*, which is engaged by an arm 21 of a handle 20. This handle 20 is pivotably mounted on a bearing 18 shown in FIG. 8, and it forms a connection or switching member. As can be seen, the handle 20 is designed as a one-armed lever, which is pivotably mounted at its upper end. A lug 20*a*, which is arranged under the pivot axis S and is directed radially in the outward direction, is placed on the top side 12*a*, and it holds the arm 21 in the position shown in FIG. 1. The handle 20 is detachably snapped into a snap-in hole 18*a* (FIG. 8) of a stilt 17.

If the weight body 13 is raised for triggering a partial flushing, the valve body 7 is also raised at the same time due to at least one web 23 made in one piece with the valve body 7 being in contact with the laterally projecting underside 25*b* of a snap-in pin 25*a*. The handle 20, arranged approximately at the lower end of the weight body 13, is at the same time raised off the lid 12, and an edge 12*c* engages the arm 21, and it pivots the arm 21 inwardly toward the valve body 7 in the direction of the arrow 36. As a result, a step 22 of the arm 21 is moved radially inwardly into a position in which the arm 21 is located above an outwardly projecting shoulder 23. This is the stable position of the handle 20, which is maintained when the weight body 13 is raised. As in the case of complete flushing, the valve disk 9 is raised off the valve seat 10, and flushing is thus triggered. A lifting force is again exerted on the valve body 7 by the float 8. The weight body 13 becomes increasingly heavier as the flushing water level 37 drops. The progressively increasing weight of the weight body 13 loads the valve body 7 due to the handle 20 lying on the shoulder 23. The weight body 13 is designed such that it overcomes the lifting force of the float 8 a relatively short time after the flushing was triggered, and it forces the valve body 7 onto the valve seat 10, thus interrupting the flushing, before the flush tank 2 is completely emptied. The lug 20*a* of the handle 20 comes into contact with the surface 12*a* during this closing movement, and it again pivots the arm 21 into the position shown in FIG. 1, in which the step 22 is located radially next to the shoulder 23, so that the valve body 7 can be raised for triggering a complete flushing without the weight body 13. After the completion of the flushing, the flush tank is again filled up in the known manner through an inlet valve, not shown here, to the level 37 indicated in FIG. 1. The flushing means is thus again ready for an optimal partial or complete flushing.

The embodiment according to FIG. 2 has a design similar to that according to FIG. 1, and it is also similar functionally. However, it is not as high and is intended for a surface-mounted flush tank. The actuating device may have the same design as the device 33 shown in FIG. 3. The pulling element 26 is connected in this case to a weight body 113, with which an upwardly projecting arm 115 is made in one piece. A web 141, which forms a stop at a projecting shoulder 140 of a valve body 107, is made in one piece with and above a container 116, which is located under the flushing water level 37 when the flushing tank 102 is full. Thus, when the weight body 113 is raised with the pulling element 26, the valve body 107 is raised at the same time as well. The lug 120*a* of a handle 120, which lies on a top side 111*a* of a lid 111, is raised off the lid 111, after which the arm 121 is pivoted in the direction of arrow 136, and this arm 121 supports the weight body 113 at a shoulder 123 when the valve body 107 is raised. The shoulder 123 is arranged within the housing 104, as in the design according to FIG. 1. Like the lid 12, the lid 111 is rotatably attached to the housing 104 with a snap-in means 131. The snap-in means is designed such that the lid 111 is freely rotatable on the housing 104. This is also true of the lid 12. The weight body 113 is thus rotatable in any position around the axis A of the valve body 107, as a result of which it can be accurately aligned with the pulling element 26. A design in which the function of the web 141 is assumed by the handle 120 is conceivable as well. Equally conceivable is a design in which an additional switching element, which assumes the function of the web 141, is provided. As can be seen, the valve body 107 has, to a large extent, the usual design and is not burdened by any switching elements or other parts which would increase its weight. The lifting force of the float 108 can thus be minimal and the float housing 104 can be designed as a correspondingly slim housing. This is essential especially for compact concealed flush tanks.

While specific embodiments of the invention have been shown and described in detail to illustrate the application of the principles of the invention, it will be understood that the invention may be embodied otherwise without departing from such principles.

What is claimed is:

1. A flushing device for a toilet flush tank, comprising:

actuating means including a partial flushing actuator for actuating a partial flushing and a complete flushing actuator for actuating a complete flushing;

a drain fitting including a valve body, said valve body being raised from an opening of the flush tank for optionally triggering one of a complete flushing and a partial flushing, said drain fitting including a float for maintaining said valve body raised during said complete flushing;

weight body means connected to said valve body and being connected to said partial flushing actuator and being raised with said valve body in the case of partial flushing whereby said weight is directly raised with said partial flushing actuator to load said valve body with weight to prematurely place said valve body into a closed position against a lifting force of said float, after triggering a partial flushing;

coupling means disposed between said valve body and said weight body, said coupling means including a switching member which is mounted on said weight body in a lower area of said weight body and with a switching member arm disposed in an inactive position during complete flushing, wherein said valve body moves independently of said weight body, and with said switching member arm disposed in an active position in coupling contact with a surface of said valve body for automatically connecting said weight body to said valve body to load said valve body with weight when said weight body is raised with said partial flushing actuator.

2. A flushing device according to claim 1, wherein said switching member includes a handle.

3. A flushing device according to claim 1, wherein said drain fitting includes a housing, said switching member being functionally connected to said housing for being moved by said housing.

4. A flushing device according to claim 1, wherein said drain fitting includes a lid, said switching member being functionally connected to said lid for being moved by said lid.

5. A flushing device according to claim 4, wherein said lid is rotatably mounted on said drain fitting.

6. A flushing device according to claim 1, wherein said switching member includes an arm, said arm being pivoted during a raising of said weight body, said arm supporting said weight body on said valve body when said valve body is raised.

7. A flushing device according to claim 6, wherein said valve body includes a shoulder, said arm supporting said weight body on said shoulder of said valve body.

8. A flushing device according to claim 1, wherein said switching member includes a control element, said drain fitting including a housing, said control element cooperating with said housing at an end of a partial flushing to uncouple said switching member.

9. A flushing device according to claim 1, further comprising a stop arranged on said weight body for raising said valve body.

10. A flushing device according to claim 1, wherein said weight body includes an upwardly projecting arm, said partial flushing pulling element engaging said upwardly projecting arm at an upper end of said upwardly projecting arm.

11. A flushing device according to claim 1, wherein said switching member includes a handle mounted at a lower end of said weight body, said drain fitting including a housing, said handle being automatically moved by said housing into a functional connection with said valve body during a raising of said weight body, said handle being automatically returned by said housing during a lowering of said weight body.

12. A flushing device according to claim 1, wherein said weight body includes two downwardly projecting slits at a lower end of said weight body, under a container defining said weight body.

13. A flushing device according to claim 1, wherein said weight body includes an upwardly projecting arm, said partial flushing actuator including a pulling element connected to said upwardly projecting arm, said complete flushing actuator including pulling element connected to an upper end of said valve body.

14. A flushing device according to claim 1, wherein said weight body forms a unit with said switching member, said unit being supported on said housing of said drain fittings in a resting state and being functionally connected to said switching member for controlling said switching member.

15. A flushing device drain fitting, comprising:

actuating means including a partial flushing actuator for actuating a partial flushing a complete flushing actuator for actuating a complete flushing;

a housing and a valve body mounted in said housing and a weight body which is supported on said housing, said weight body being connectable with said valve body for loading said valve body;

a connection member for coupling said weight body with said valve body, said connection member being connected to said weight body adjacent to a lower end of said weight body, said connection member being movable between an inactive position, during complete flushing, wherein said valve body moves independently of said weight body, and a coupling position, with said connection member in coupling contact with a surface of said valve body, by a housing surface edge upon said partial flushing actuator raising said weight body and moving said body and said connection member relative to said housing, such that said housing moves said connection member during a raising of said weight body into said coupling position so as to load said raised valve body with said weight body.

16. A drain fitting according to claim 15, wherein said valve body includes a shoulder within said housing, said connection member including an arm which engages said housing and is moved toward said shoulder during a raising of said weight body.

17. A flushing device drain fitting, comprising:

actuating means including a partial flushing actuator for actuating a partial flushing and a complete flushing actuator for actuating a complete flushing;

a housing disposed adjacent to an opening of said flush tank;

a drain fitting including a valve body movable between a closed position dosing the opening of the flush tank and an open position raised from the opening of said flush tank, said valve body being connected to each of said partial flushing actuator and complete flushing actuator, said drain fitting including a float for regulating the dissent of the said valve body after said valve body is raised during flushing, said housing including guide surfaces for guiding said valve body during movement of said valve body;

a weight body disposed in contact with said valve body, said valve body being independently movable relative to said weight body, said weight body being connected to said partial flushing actuator and being raisable by said partial flushing actuator whereby a weight of said weight body is directly raised by said partial flushing actuator, said weight body being supported at an upper end of said housing; and a coupling element pivotably connected to a bottom end of said weight body, said coupling member being movable between an inactive position, during complete flushing, wherein said valve body moves independently of said weight body, and a coupling position, with said connection member in coupling contact with a surface of said valve body, wherein said weight body is supported by said valve body, said housing including a switching surface for moving said coupling member into said coupling position for automatically connecting said weight body to said valve body to load said valve body with weight when said weight body is raised with said partial flushing actuator.

* * * * *